United States Patent [19]

Kurokawa

[11] 4,015,545

[45] Apr. 5, 1977

[54] SHELF ASSEMBLY

[75] Inventor: Masayuki Kurokawa, Tokyo, Japan

[73] Assignee: Nittetsu Curtainwall Corporation, Tokyo, Japan; a part interest

[22] Filed: July 24, 1975

[21] Appl. No.: 598,693

[30] Foreign Application Priority Data

July 25, 1974 Japan ..... 49-87691[U]

[52] U.S. Cl. ..... 108/107; 52/580; 52/619; 108/111; 211/187; 312/257 R

[51] Int. Cl.² ..... A47S 47/04

[58] Field of Search ..... 108/23, 64, 106, 107, 108/158, 111; 52/36, 580, 615, 619, 620, 621; 312/223, 257 R, 257 SK, 257 SM, 257 A, 108, 214, 330; 211/186, 187

[56] References Cited

UNITED STATES PATENTS

| | | | |
|---|---|---|---|
| 1,966,928 | 7/1934 | Friedel | 108/64 |
| 3,341,270 | 9/1967 | Sohl | 312/257 R X |
| 3,598,464 | 8/1971 | Morozink | 312/223 X |
| 3,624,780 | 11/1971 | Elliot et al. | 52/36 X |
| 3,717,936 | 2/1973 | Dupree | 312/257 R |
| 3,892,189 | 7/1975 | Killiam | 108/111 X |

FOREIGN PATENTS OR APPLICATIONS

| | | | |
|---|---|---|---|
| 1,381,522 | 11/1964 | France | 108/107 |

*Primary Examiner*—James T. McCall
*Assistant Examiner*—William E. Lyddane
*Attorney, Agent, or Firm*—Wenderoth, Lind & Ponack

[57] ABSTRACT

A shelf assembly comprising a side board and a shelf board, said side board having a flat inside surface, an outer surface and a flange extending outward from the edge of the outer surface, and said side board being designed to be mated with another side board on their outer surfaces so as to provide a space for wirings for illumination and fixing means for the shelf board.

5 Claims, 5 Drawing Figures

SHELF ASSEMBLY

SUMMARY OF THE INVENTION

1. Field of the Invention

The present invention relates to a shelf assembly. Shelves are used to hold various goods, and when they are used as a display shelf for displaying merchandise it is often necessary to provide the shelf with illumination devices for illuminating merchandise, and when merchandise is displayed on a wide shelf floor, a plurality of shelves are connected in parallel and supported on a frame or a structure.

2. Description of the Prior Art

Conventional shelf assemblies, particularly those to be used with an illumination device, have no means for accomodating the wiring and wiring accessories for the illumination device and thus the wiring and wiring accessories are exposed on the shelf assembly, or when they are used in a connected manner (connected side by side or connected to the structure), the connecting members are not concealed but exposed to the eyes, thus deteriorating the ornamental effects, which are very important for the shelf assembly for displaying merchandise. Meanwhile, when the wiring or the connection to the structure is done on the back side of the shelf assembly, the workings are very troublesome.

Therefore, the object of the present invention is to provide a shelf assembly which can be easily connected side by side or connected to the structure and which can conceal the wiring and wiring accessories, and connecting members inside the shelf assembly so that they are not exposed to the eyes.

According to the present invention, the outside of a side board on which a shelf is supported is provided with a space for the wiring and wiring accessories, means for permitting a shelf fixing member to pass through, and means for fixing the side board to another side board when they are connected.

PREFERRED EMBODIMENTS OF THE INVENTION

The present invention will be described by referring to the attached drawings.

BRIEF DESCRIPTION OF THE DRAWINGS

In FIG. 1, the side board 1 has an inner flat side 2 and an outer side which is provided with bend projections 3A and 3B at both ends, a central projection 4 having a crank-like cross-section, spacer projections 5A and 5B symmetrically arranged with respect to the projection 4, a tubular portion 6 for a connecting a bolt, and projections 7 defining a space for wirings. The bent projections 3A, 3B, the central projection 4, and the spacer projections 5A and 5B are of substantially the same height.

The side board 1 may be made of metals such as aluminum, steel, and plastic and may be formed by extrusion.

Figure 1:
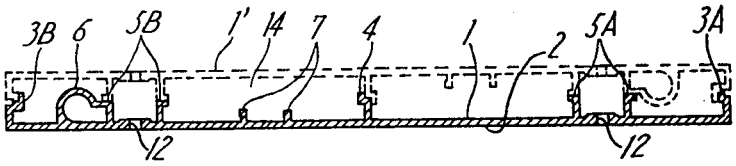
FIG. 1 is a cross-sectional view of a side board of a shelf assembly according to the present invention, when connected to a side board of an annex shelf assembly.
Figure 2:
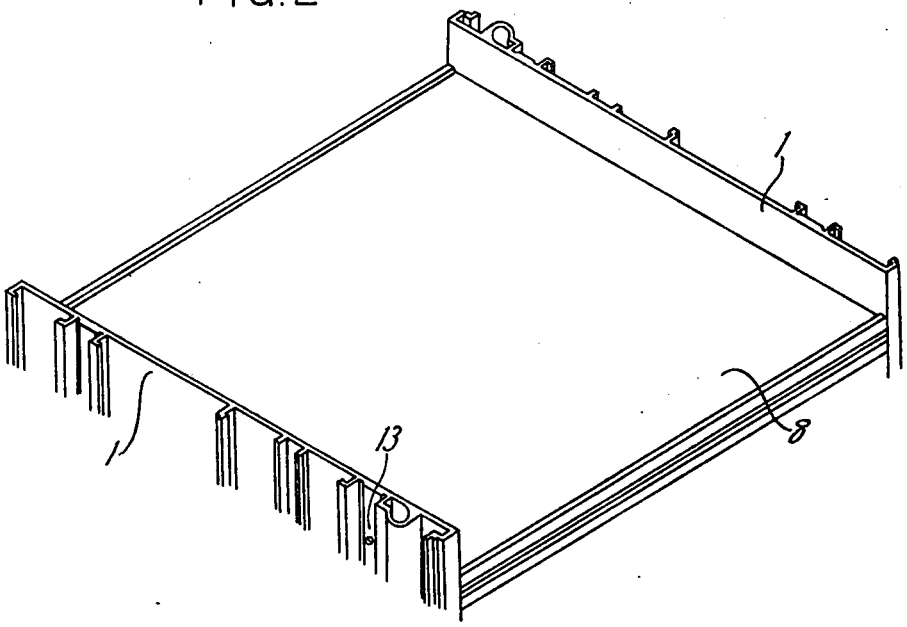
FIG. 2 is a slant view of a part of the shelf assembly according to the present invention.
Figure 3:
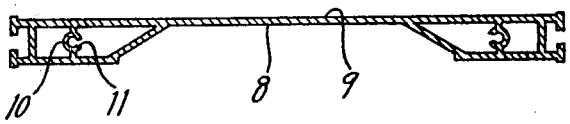
FIG. 3 is a cross sectional view of the shelf board of the shelf assembly according to the present invention.

In FIG. 2, a pair of the side boards as shown in FIG. 1 are made to stand spaced apart with their inner flat sides 2 opposite each other, and a shelf board 8 is fixed at both ends to the side boards 1. The shelf board 8 has a flat upper side 9 and both side portions are of double structure as shown in FIG. 3. Through the spaces of these double structures, a pipe 11 having an axial slit 10 is provided and is integrally supported by the upper and lower plates of the double structure. The shelf board 8 has a width corresponding to the width of the side board 1 and is made of the same material as the side board 1. The shelf board 8 is placed between the pair of the side boards with both end faces contacting the inner side surfaces of the side boards and is fixed to the side boards by a fastening means such as a self-tapping screw 13 or other suitable screws through a penetration hole 12 (FIG. 1) formed through the side boards at a position corresponding to the position of the pipe of the shelf board 8.

Therefore, when the above shelf assemblies are connected side by side as shown in FIG. 1, the side board 1 and the side board 1′ of the adjacent shelf assembly contact each other at the bent projections 3A, 3B, the central projection 4 and spacer projections 5A and 5B with a space 14 therebetween. This space 14 can be utilized in various ways. For example, the space can be used for the wirings, for connecting the side boards, and for connecting a connecting bolt fixed on a ceiling of a structure to the connecting pipe 6. The space 14 is concealed by the bent projections 3A and 3B when viewed from the front side of the shelf assembly, thus maintaining the ornamental appearance of the shelf assembly and thus being very useful for decorative display of the merchandise.

Further, the central projection 4, the bent projections 3A, 3B have a crank-like end so that when the side board 1 and the side board 1′ are faced side by side, these projections engage with the corresponding projections and prevent the displacement of these side boards from each other. Thus, when one shelf assembly of the above structure is fixed to a structure, the adjacent shelf assembly is indirectly fixed to the structure by fixing the adjacent assembly to the former shelf assembly by means of a common bolt inserted in the penetration holes 12 of the side boards 1 and 1′.

Figure 4:
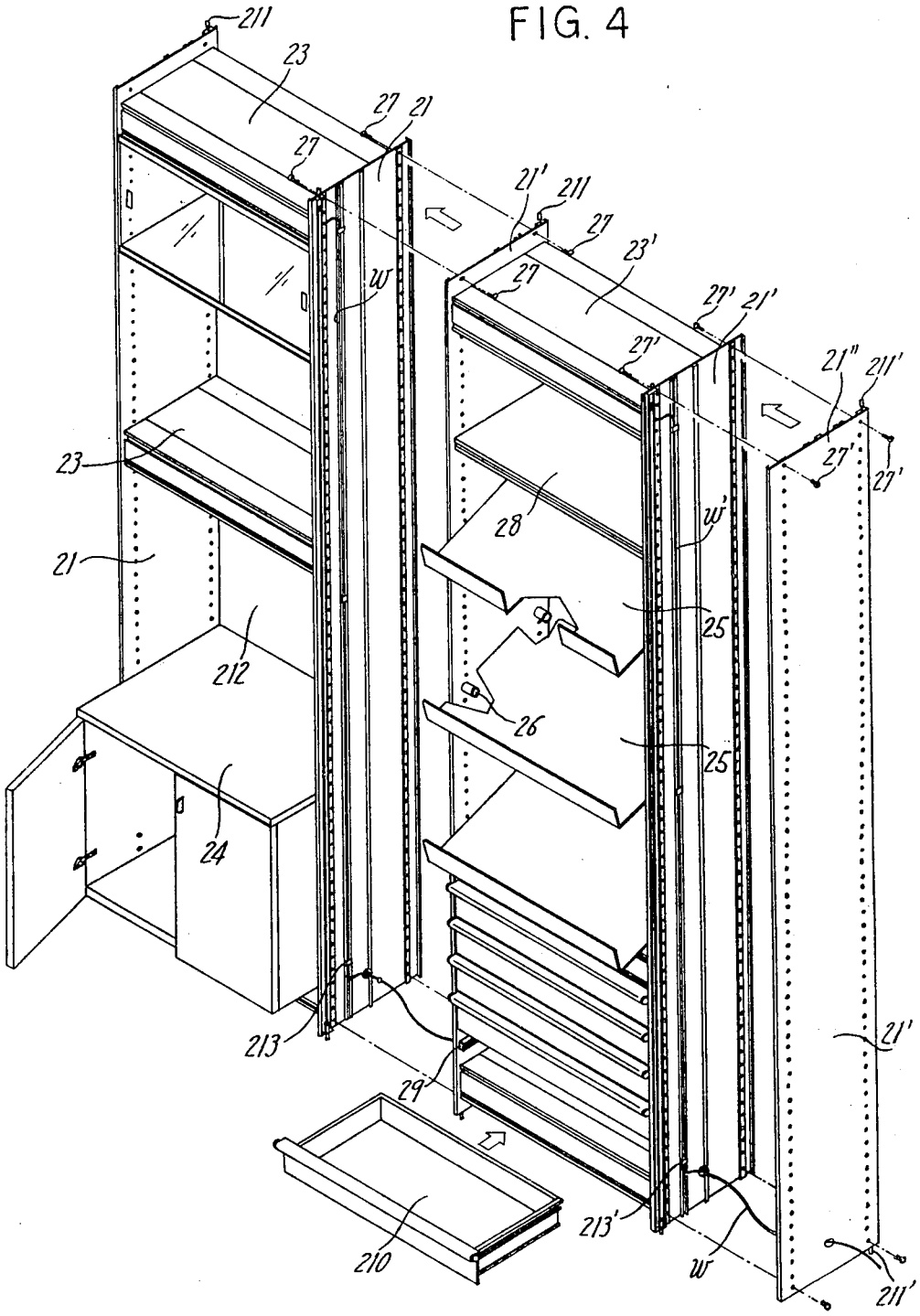
FIG. 4 shows shelf assemblies connected side by side according to the present invention.
Figure 5:
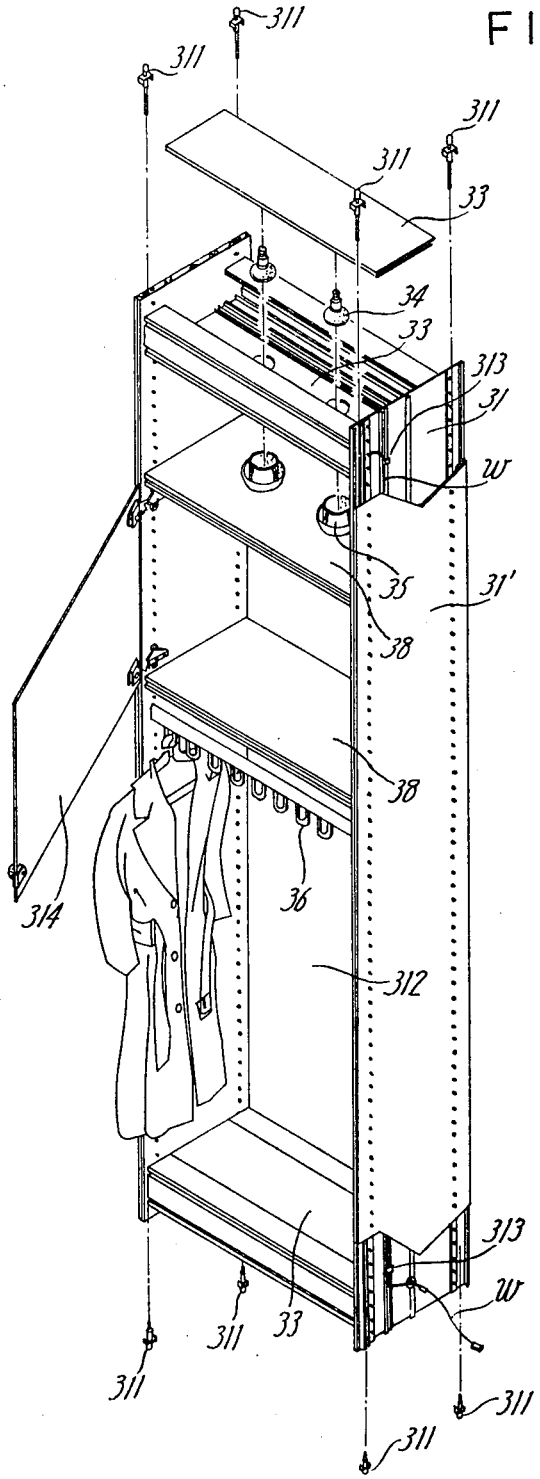
FIG. 5 shows a shelf assembly according to the present invention used in a separate manner.

FIG. 4 and FIG. 5 show respectively another embodiment of the present invention.

In FIG. 4, a series of the same or various shelf assemblies are connected side by side by connecting the side boards 21, 21′, 21″ . . . and the wiring *w*, *w*′, wiring accessories 213, 213′, 313, 313′ and other fittings are concealed from the eyes in the spaces provided between the side boards.

FIG. 4 shows an embodiment in which the first shelf assembly is connected side by side to the second shelf assembly by means of a bolt and nut 27, 27′, and the wiring *w* for the illumination and its accessories as well as fittings for the shelf and other devices are concealed between the side boards 21 and 21′.

In FIG. 4, 23, and 23′ are illumination panels, 24 is a box closet, 25 is a slant shelf board, 26 is a stopper for the slant shelf board, 28 is a horizontal shelf board, 29 is a rail for a drawer 210, 211, and 211′ are adjusters, 212 is a back board, and 213 is a code clipper.

FIG. 5 shows a separate shelf assembly in which the side board 31 is connected side by side with the side board 31' so that the wiring *w* and its accessories such as the code clipper 313 and the fixing members for shelf boards etc. are concealed between the side boards 31 and 31', with the flat sides of these boards being exposed.

In FIG. 5, 311 is an adjuster, 314 is a door, 33 is an illumination panel, 34 is a lamp, 35 is a lamp shade, 36 is a hanger unit, 38 is a horizontal shelf board.

As described above, the present invention has the advantages that the wiring and connectings operations, etc. can be done very easily because the wiring and connecting etc. are done on the outer side of the side board, and thus the ornamental value is not deteriorated, and the shelf assemblies can be connected side by side in a satisfactory and easy manner, so that a wide display floor can be easily obtained and so that the components of the shelf assembly can be manufacture in mass-production at low production cost.

What is claimed is:

1. A shelving assembly comprising:

shelf board means for supporting articles thereon; and a plurality of side board means on two sides of said shelf board means for supporting said shelf board means, each side board means having:

an inner flat side adjacent said shelf board, and an outer side opposite said inner side, said outer side having:

bent first projections having crank-like cross-sections at both ends of the sides of said side board means, a bent second projection having a crank-like cross-section at the center of said outer side, a plurality of third spacer projections symmetrically arranged on both sides of said second projection, said first, second and third projections being substantially the same height, said first and second bent projections being engageable with corresponding bent projections of a similar side board means placed adjacent thereto, and said third projection also engageable with corresponding third projections on said similar side board means adjacent thereto, whereby said adjacent side board means are spaced from each other by said projections, and a tubular portion formed on said outer side of said side board means.

2. An assembly as claimed in claim 1 wherein said outer side of said side board means further has a pair of fourth projections above the surface thereof defining a space for containing electrical wiring.

3. An assembly as claimed in claim 1 wherein said side board means has a plurality of holes therein between said second projections for connecting said shelf board means to said side board means.

4. An assembly as claimed in claim 1 wherein said shelf board means has a flat upper surface and double walled end portions at the ends of said flat upper surface.

5. An assembly as claimed in claim 4 wherein said shelf board means further has a pipe having an axial slit therethrough fitted and supported between the upper and lower surfaces of both of said double walled portions at the ends of said upper flat surface.

* * * * *